US011319115B2

(12) United States Patent
Yang et al.

(10) Patent No.: US 11,319,115 B2
(45) Date of Patent: May 3, 2022

(54) SEALING BAG AND RELATED SEALING SYSTEM

(71) Applicant: Universal Trim Supply Co., Ltd., New Taipei (TW)

(72) Inventors: Chih-Wei Yang, Taipei (TW); Shih-Sheng Yang, Taipei (TW); Hou-Chun Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 0 days.

(21) Appl. No.: 16/835,327

(22) Filed: Mar. 31, 2020

(65) Prior Publication Data

US 2021/0300632 A1 Sep. 30, 2021

(51) Int. Cl.

| | |
|---|---|
| ***B65D 33/16*** | (2006.01) |
| ***B65D 33/25*** | (2006.01) |
| ***B65D 81/20*** | (2006.01) |

(52) U.S. Cl.

CPC ..... *B65D 33/2589* (2020.05); *B65D 81/2023* (2013.01)

(58) Field of Classification Search

CPC ..... B65D 33/2591; B65D 81/2023

USPC ..... 383/64, 68, 69

See application file for complete search history.

(56) References Cited

U.S. PATENT DOCUMENTS

| | | | | | |
|---|---|---|---|---|---|
| 2,500,363 | A * | 3/1950 | Koeppel | A61F 7/086 | 383/59 |
| 3,381,883 | A * | 5/1968 | Harris | B65D 5/069 | 229/125.19 |
| 3,422,997 | A * | 1/1969 | John | B65D 47/26 | 222/542 |
| 3,693,864 | A * | 9/1972 | Wilkins | B65D 5/069 | 229/125.12 |
| 4,252,238 | A * | 2/1981 | Spiegelberg | B65D 83/08 | 206/274 |
| 4,428,098 | A * | 1/1984 | Coker | B65D 33/1675 | 24/30.5 R |
| 4,509,196 | A * | 4/1985 | Sak | B65D 33/20 | 283/109 |
| 4,510,621 | A * | 4/1985 | Sak | B65D 33/20 | 229/80 |
| 4,541,117 | A * | 9/1985 | Ashbeck | B65D 33/1666 | 220/684 |

(Continued)

*Primary Examiner* — Peter N Helvey

(74) *Attorney, Agent, or Firm* — Winston Hsu

(57) ABSTRACT

A sealing bag includes a bag body and a sealing system. The sealing system includes an elastomeric protruding component and a covering assembly. The elastomeric protruding component is disposed on the bag body and protruding from the bag body along a protruding direction. A slit penetrates through the elastomeric protruding component along the protruding direction and is communicated with an inner space of the bag body. The covering assembly is for detachably engaging with the elastomeric protruding component. The covering assembly squeezes the elastomeric protruding component along the protruding direction and a lateral direction different from the protruding direction to seal the slit when the covering assembly engages with the elastomeric protruding component. Such mechanism can ensure nothing goes in or comes out when the slit is sealed. Therefore, the present invention has enhanced reliability.

25 Claims, 19 Drawing Sheets

(56) References Cited

U.S. PATENT DOCUMENTS 4,709,399 A * 11/1987 Sanders ..... B65D 33/20 229/80
4,979,668 A * 12/1990 Allen ..... B65D 5/069 229/125.12
5,226,734 A * 7/1993 Scott ..... B42F 15/0035 229/67.2
5,287,960 A * 2/1994 Kalb ..... A61G 9/00 206/440
5,354,132 A * 10/1994 Young ..... A61F 5/44 383/10
5,405,034 A * 4/1995 Mittel, Jr. ..... B65D 45/02 215/322
5,462,222 A * 10/1995 Boeck, II ..... B65D 5/069 229/125.12
6,074,094 A * 6/2000 Manolizi ..... A45C 13/1023 24/30.5 L
6,196,716 B1 * 3/2001 Geyer ..... B65D 33/34 383/42
6,464,394 B1 * 10/2002 Galomb ..... B65D 31/10 24/30.5 R
6,913,388 B2 * 7/2005 Laske ..... B65D 33/20 383/88
7,503,696 B2 * 3/2009 Ha ..... B65D 33/007 24/30.5 R
8,043,005 B2 * 10/2011 Lyon ..... B65D 33/2591 383/69
8,186,881 B2 * 5/2012 Lyon ..... B65D 33/2591 383/69
9,643,759 B2 * 5/2017 Fily ..... B65D 47/286
2007/0101682 A1 * 5/2007 Tilman ..... B65B 31/04 53/434
2007/0280564 A1 * 12/2007 Lyon ..... B65D 33/2591 383/69
2008/0166073 A1 * 7/2008 Crunkleton ..... B65D 33/2591 383/5
2012/0087603 A1 * 4/2012 Chen ..... B65D 33/1666 383/69
2014/0185964 A1 * 7/2014 Fily ..... B65D 47/286 383/69

* cited by examiner

SEALING BAG AND RELATED SEALING SYSTEM

BACKGROUND OF THE INVENTION

1. Field of the Invention

The present invention relates to a sealing bag and a sealing system, and more particularly, to a sealing bag and a sealing system with enhanced reliability.

2. Description of the Prior Art

With advancement of technology and development of economy, there are more and more consumer goods available in the market. For example, a storage product, such as a sealing bag, for food storage is one of the consumer goods. The conventional storage product usually includes a zipper for providing a sealing effect to prevent leakage of the food and keep the food fresh. However, if there is a particle between a male member and a female member of the zipper or there is any deformation of the male member or the female member of the zipper, the male member and the female member cannot be mated with each other properly, which may reduce the sealing effect of the storage product to cause leakage of the food or spoilage of the food.

SUMMARY OF THE INVENTION

Therefore, it is an objective of the present invention to provide a sealing bag and a sealing system with enhanced reliability for solving the aforementioned problems.

In order to achieve the aforementioned objective, the present invention discloses a sealing bag which includes a bag body and a sealing system. The sealing system includes an elastomeric protruding component and a covering assembly. The elastomeric protruding component is disposed on the bag body and protrudes from the bag body along a protruding direction. A slit penetrates through the elastomeric protruding component along the protruding direction and is communicated with an inner space of the bag body. The covering assembly is for detachably engaging with the elastomeric protruding component. The covering assembly squeezes the elastomeric protruding component along the protruding direction and a lateral direction different from the protruding direction to seal the slit when the covering assembly engages with the elastomeric protruding component. The covering assembly includes a covering component and a sealing component. The covering component is for engaging with the elastomeric protruding component and squeezing the elastomeric protruding component along the lateral direction. The sealing component is disposed on the covering component. The sealing component squeezes the elastomeric protruding component along the protruding direction when the covering component engages with the elastomeric protruding component.

According to an embodiment of the present invention, the elastomeric protruding component includes at least one first interlocking portion, and the covering component includes at least one second interlocking portion for detachably engaging with the at least one first interlocking portion.

According to an embodiment of the present invention, the sealing component is detachably installed on or co-molded with the covering component.

According to an embodiment of the present invention, the sealing component is a single-layer structure or a multi-layer structure.

According to an embodiment of the present invention, the multi-layer structure includes a plurality of layer components made of materials with different hardness.

According to an embodiment of the present invention, the sealing component is made of elastomeric material.

According to an embodiment of the present invention, the covering component engages with the elastomeric protruding component in a sliding manner or a snapping manner.

According to an embodiment of the present invention, the lateral direction is perpendicular to the protruding direction, and the elastomeric protruding component extends along an extending direction perpendicular to the protruding direction and the lateral direction.

According to an embodiment of the present invention, the sealing system further includes a vacuum valve disposed on the bag body for allowing or restraining discharge of fluid inside the inner space of the bag body.

According to an embodiment of the present invention, the covering component is attached to or separated from the bag body.

According to an embodiment of the present invention, the covering component is attached to or separated from the elastomeric protruding component.

According to an embodiment of the present invention, the sealing system further includes a buckling assembly. The buckling assembly includes a first buckling component detachably disposed on the covering component and a second buckling component detachably disposed on the elastomeric protruding component for being detachably buckled with the first buckling component.

In order to achieve the aforementioned objective, the present invention further discloses a sealing system for a container. The sealing system includes an elastomeric protruding component and a covering assembly. The elastomeric protruding component is disposed on the container. A slit penetrates through the elastomeric protruding component and is communicated with an inner space of the container. The covering assembly includes a covering component for detachably engaging with the elastomeric protruding component. The covering assembly squeezes the elastomeric protruding component along two different directions to seal the slit when the covering component engages with the elastomeric protruding component.

According to an embodiment of the present invention, the elastomeric protruding component includes at least one first interlocking portion, and the covering component includes at least one second interlocking portion for detachably engaging with the at least one first interlocking portion.

According to an embodiment of the present invention, the covering assembly further includes a sealing component disposed on the covering component, and the sealing component seals the slit when the covering component engages with the elastomeric protruding component.

According to an embodiment of the present invention, the sealing component is detachably installed on or co-molded with the covering component.

According to an embodiment of the present invention, the elastomeric protruding component protrudes from the container along a protruding direction. The slit penetrates through the elastomeric protruding component along the protruding direction, and the covering assembly squeezes the elastomeric protruding component along the protruding direction and a lateral direction perpendicular to the protruding direction to seal the slit when the covering component engages with the elastomeric protruding component.

According to an embodiment of the present invention, the elastomeric protruding component extends along an extending direction perpendicular to the protruding direction and the lateral direction.

According to an embodiment of the present invention, the sealing component is a single-layer structure or a multi-layer structure.

According to an embodiment of the present invention, the multi-layer structure comprises a plurality of layer components made of materials with different hardness.

According to an embodiment of the present invention, the sealing component is made of elastomeric material.

According to an embodiment of the present invention, the covering component engages with the elastomeric protruding component in a sliding manner or a snapping manner.

According to an embodiment of the present invention, the elastomeric protruding component protrudes from the container along a protruding direction. The elastomeric protruding component extends along an extending direction perpendicular to the protruding direction, and the covering assembly squeezes the elastomeric protruding component along the protruding direction and a lateral direction perpendicular to the protruding direction and the extending direction to seal the slit when the covering component engages with the elastomeric protruding component.

According to an embodiment of the present invention, the sealing system further includes a vacuum valve disposed on the container for allowing or restraining discharge of fluid inside the inner space of the container.

According to an embodiment of the present invention, the covering component is attached to or separated from the container.

According to an embodiment of the present invention, the covering component is attached to or separated from the elastomeric protruding component.

According to an embodiment of the present invention, the sealing system further includes a buckling assembly. The buckling assembly includes a first buckling component detachably disposed on the covering component and a second buckling component detachably disposed on the elastomeric protruding component for being detachably buckled with the first buckling component.

In summary, the present invention utilizes the covering assembly for detachably engaging with the elastomeric protruding component disposed on the bag body or the container. The covering assembly squeezes the elastomeric protruding component along two different directions to seal the slit on the elastomeric protruding component when the covering assembly engages with the elastomeric protruding component. Such mechanism can ensure nothing goes into the bag body or comes out of the bag body when the slit is sealed. Therefore, the present invention has enhanced reliability of sealing the sealing bag.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
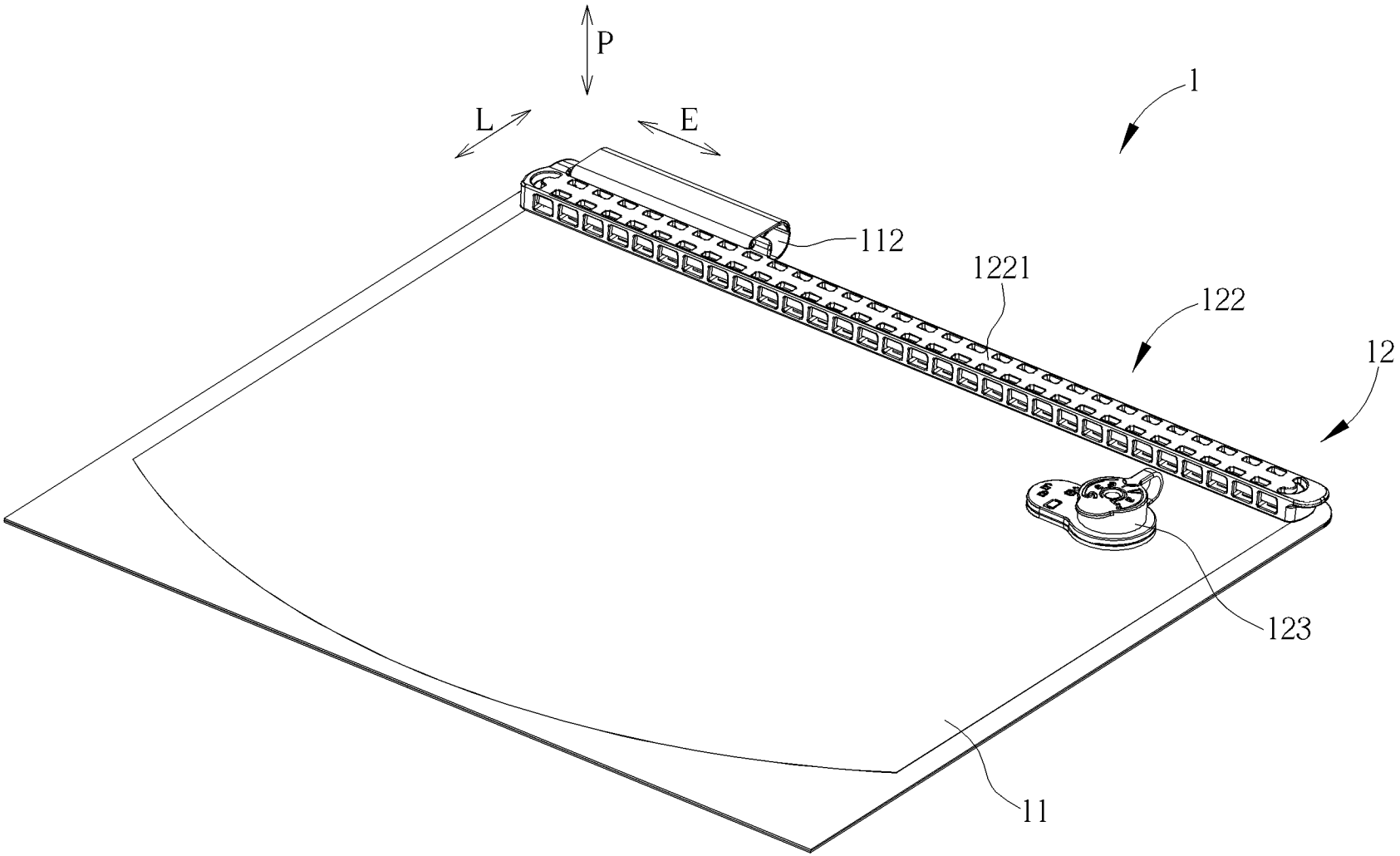
FIG. 1 is a schematic diagram of a sealing bag according to a first embodiment of the present invention.
Figure 2:
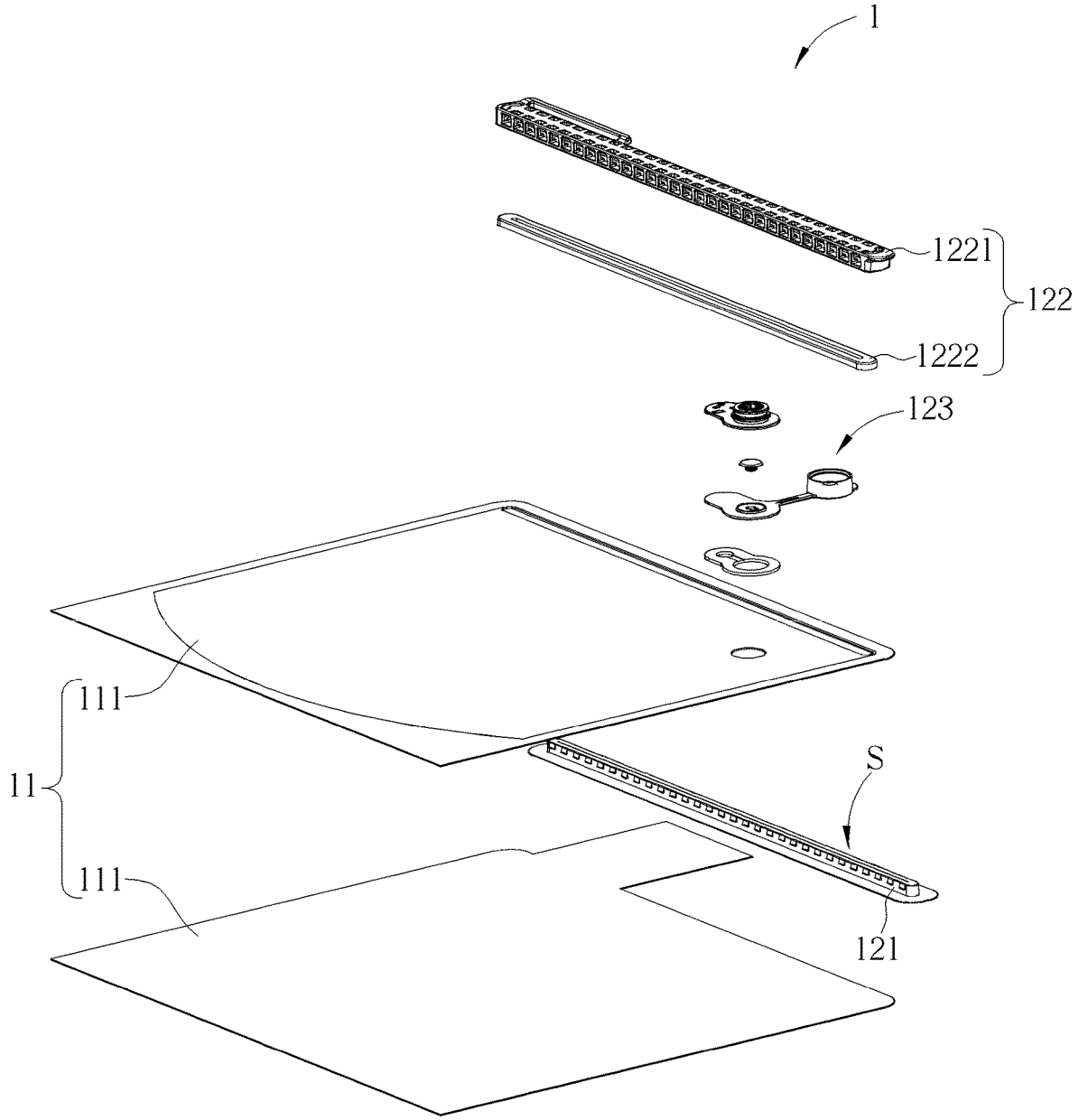
FIG. 2 is a partial exploded diagram of the sealing bag according to the first embodiment of the present invention.
Figure 3:
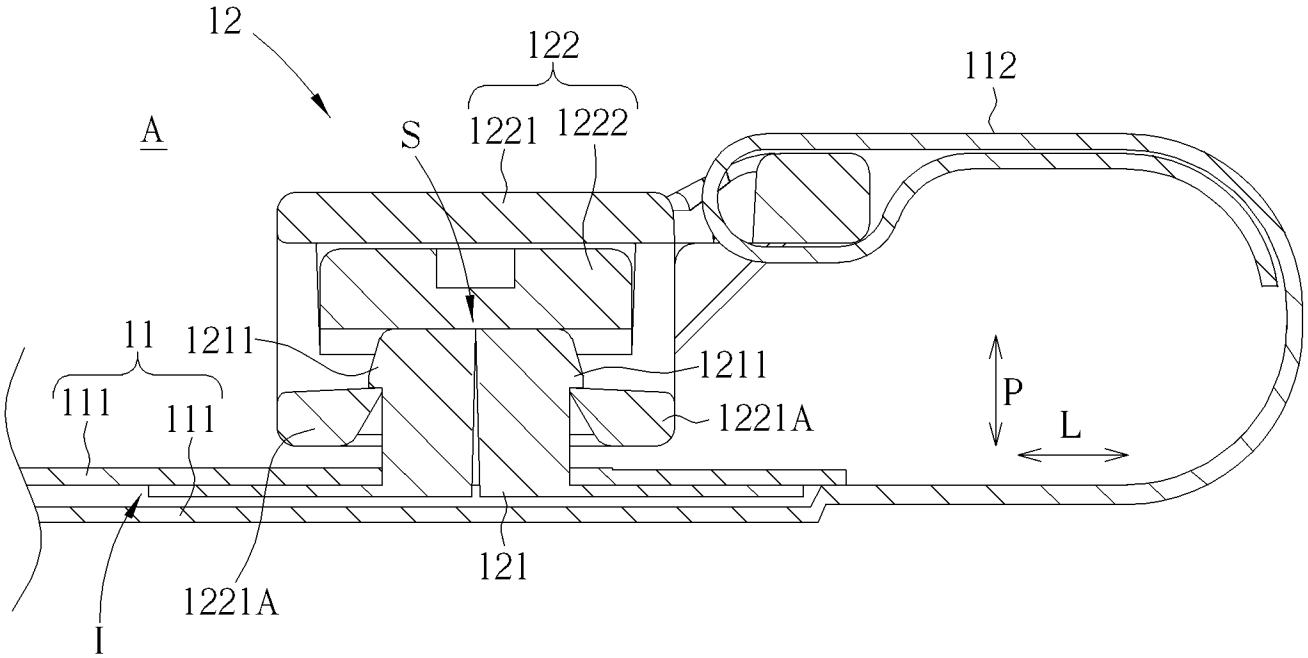
FIG. 3 is a partial enlarged sectional diagram of the sealing bag according to the first embodiment of the present invention.

Please refer to FIG. 1 to FIG. 3. FIG. 1 is a schematic diagram of a sealing bag 1 according to a first embodiment of the present invention. FIG. 2 is a partial exploded diagram of the sealing bag 1 according to the first embodiment of the present invention. FIG. 3 is a partial enlarged sectional diagram of the sealing bag 1 according to the first embodiment of the present invention. As shown in FIG. 1 to FIG. 3, the sealing bag 1 includes a bag body 11 and a sealing system 12. The bag body 11 provides an inner space I therein to store things, like food. The sealing system 12 can seal the bag body 11 to isolate the inner space I from an outer atmosphere A, as shown in FIG. 3, so that the sealing bag 1 can prevent leakage of the food and keep the food fresh. In this embodiment, the bag body 11 can include two film layers 111 combined with each other and made of plastic material, such as Polypropylene (PP), Polyethylene (PE), Polyvinyl chloride (PVC), or Thermoplastic polyurethanes (TPU), or silicone rubber, and the inner space I is enclosed by the two film layers 111. However, the structure and the material of the bag body of the present invention are not limited to this embodiment. It depends on practical demands.

Figure 4:
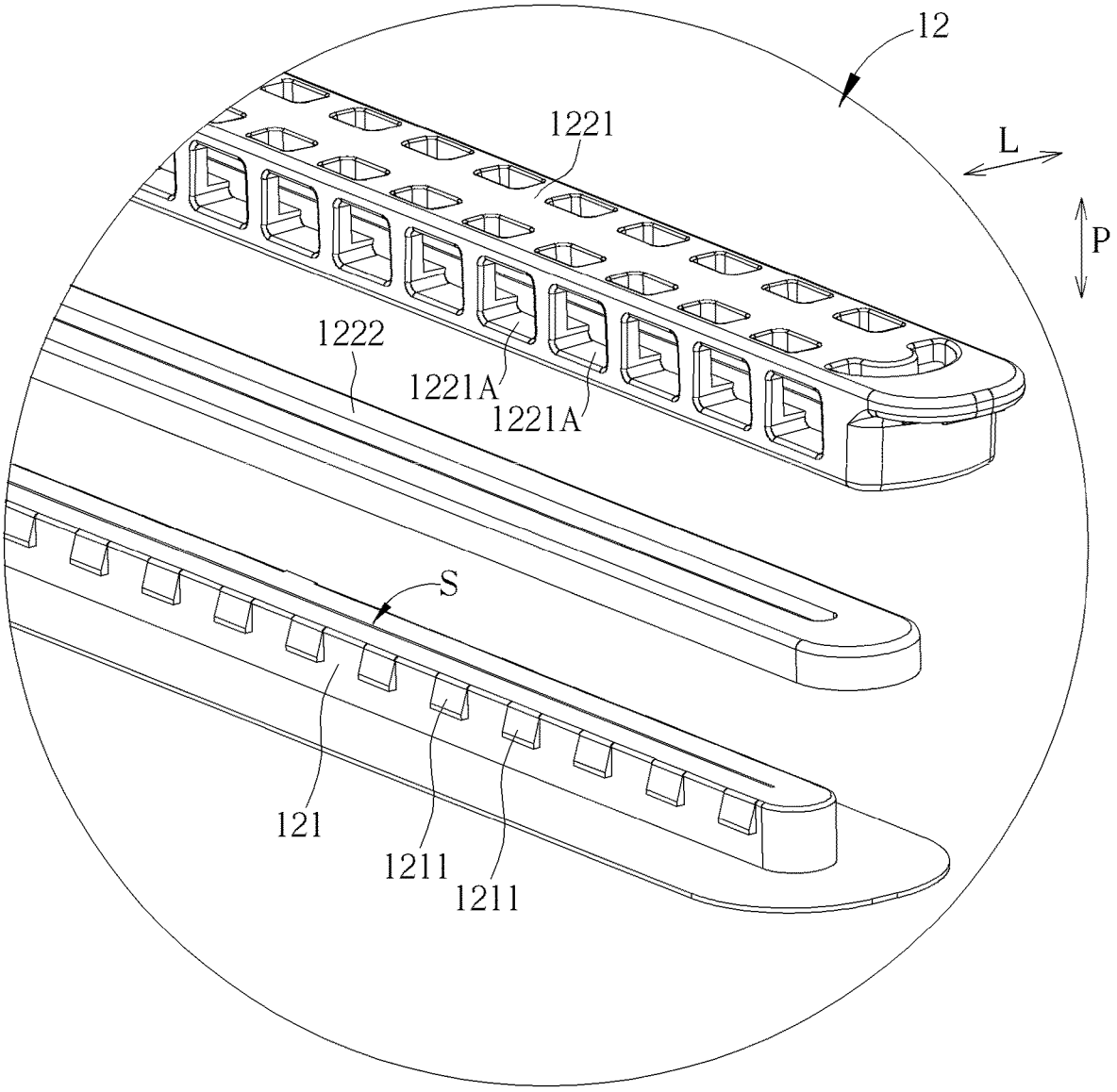
FIG. 4 is a partial enlarged exploded diagram of a sealing system according to the first embodiment of the present invention.

Please refer to FIG. 1 to FIG. 4. FIG. 4 is a partial enlarged exploded diagram of the sealing system 12 according to the first embodiment of the present invention. As shown in FIG. 1 to FIG. 4, the sealing system 12 includes an elastomeric protruding component 121 and a covering assembly 122. The elastomeric protruding component 121 is disposed on the bag body 11 and protrudes from the bag body 11 along a protruding direction P. A slit S penetrates through the elastomeric protruding component 121 along the protruding direction P and is communicated with the inner space I of the bag body 11. In this embodiment, the elastomeric protruding component 121 can be integrally combined with the bag body 11 by high frequency welding and extend along an extending direction E substantially perpendicular to the protruding direction P to form a straight-shaped structure. However, the present invention is not limited to this embodiment. It depends on practical demands. For example, in another embodiment, the bag body and the elastomeric protruding component can be a one-piece structure by injection molding, and the elastomeric protruding component can surround a periphery of the bag body.

The covering assembly 122 is for detachably engaging with the elastomeric protruding component 121 to seal the slit S. When the covering assembly 122 is detached from the elastomeric protruding component 121, the inner space I is accessible through the slit S, so as to allow a user to put things inside the inner space I or to take out things from the inner space I. When the covering assembly 122 engages with the elastomeric protruding component 121, the covering assembly 122 squeezes the elastomeric protruding component 121 along two directions, i.e., the protruding direction P and a lateral direction L different form the protruding direction P, to seal the slit S to isolate the inner space I from the outer atmosphere A. In this embodiment, the lateral direction L can be substantially perpendicular to the protruding direction P and the extending direction E. However, the present invention is not limited to this embodiment. It depends on the structure of the covering assembly. For example, in another embodiment, the lateral direction can be inclined relative to the protruding direction and the extending direction E.

Specifically, the covering assembly 122 includes a covering component 1221 for engaging with the elastomeric protruding component 121 and a sealing component 1222 disposed on the covering component 1221. In this embodiment, the covering component 1221 can be attached to the bag body 11 with a connecting component 112 by high frequency welding for preventing loss of the covering component 1221. However, the present invention is not limited to this embodiment. It depends on practical demands. For example, the covering component can be separated from the bag body, i.e., the connecting component can be omitted.

Furthermore, the elastomeric protruding component 121 includes a plurality of first interlocking portions 1211 located at two lateral portions thereof and arranged along the extending direction E, and the covering component 1221 includes a plurality of second interlocking portions 1221A located at two lateral portions thereof and arranged along the extending direction E for detachably engaging with the plurality of first interlocking portions 1211. The covering component 1221 squeezes the elastomeric protruding component 121 along the lateral direction L by cooperation of the plurality of first interlocking portions 1211 and the plurality of second interlocking portions 1221A. In this embodiment, each of the first interlocking portion 1211 and the second interlocking portion 1221A can be a tooth with an inclined surface, so that the covering component 1221 can engage with the elastomeric protruding component 121 along the protruding direction P in a snapping manner. However, the numbers and the arrangements of the first interlocking portion and the second locking portion are not limited to this embodiment. For example, in another embodiment, the elastomeric protruding component can include one first interlocking portion located at one lateral portion thereof, and the covering component can include one second interlocking portion located at one lateral portion thereof.

The sealing component 1222 squeezes the elastomeric protruding component 121 along the protruding direction P when the plurality of first interlocking portions 1211 engage with the plurality of second interlocking portions 1221A. In this embodiment, the sealing component 1222 can be a single-layer structure detachably installed on the covering component 1221 and made of elastomeric material.

In addition, in this embodiment, in order to keep food fresh or reduce an occupied space, the sealing system 12 can further include a vacuum valve 123 disposed on the bag body 11 for allowing or restraining discharge of fluid inside the inner space I of the bag body 11. The user can use a vacuum pump, which is not shown in the figures, to discharge the fluid, such as air, inside the inner space I via the vacuum valve 123. However, the present invention is not limited to this embodiment. For example, in another embodiment, the vacuum valve can be omitted.

When it is desired to store things inside the sealing bag 1 or take things out of the sealing bag 1, the covering assembly 122 can be detached from the elastomeric protruding component 121 to allow access to the inner space I of the bag body 11 through the slit S. After the things are placed into the inner space I or taken out via the slit S, the covering assembly 122 can be engaged with the elastomeric protruding component 121 to squeeze the elastomeric protruding component 121 along the lateral direction L by the covering component 1221 and along the protruding direction P by the sealing component 1222 for sealing the slit S. After the slit S is sealed by engagement of the elastomeric protruding component 121 and the covering assembly 122, the fluid, such as air, inside the inner space I of bag body 11 can be discharged via the vacuum valve 123 by the vacuum pump for long-term storage and reducing an occupied space.

However, the structure of the sealing system is not limited to this embodiment. It depends on practical demands. Other various sealing systems are provided in the following embodiments.

Figure 5:
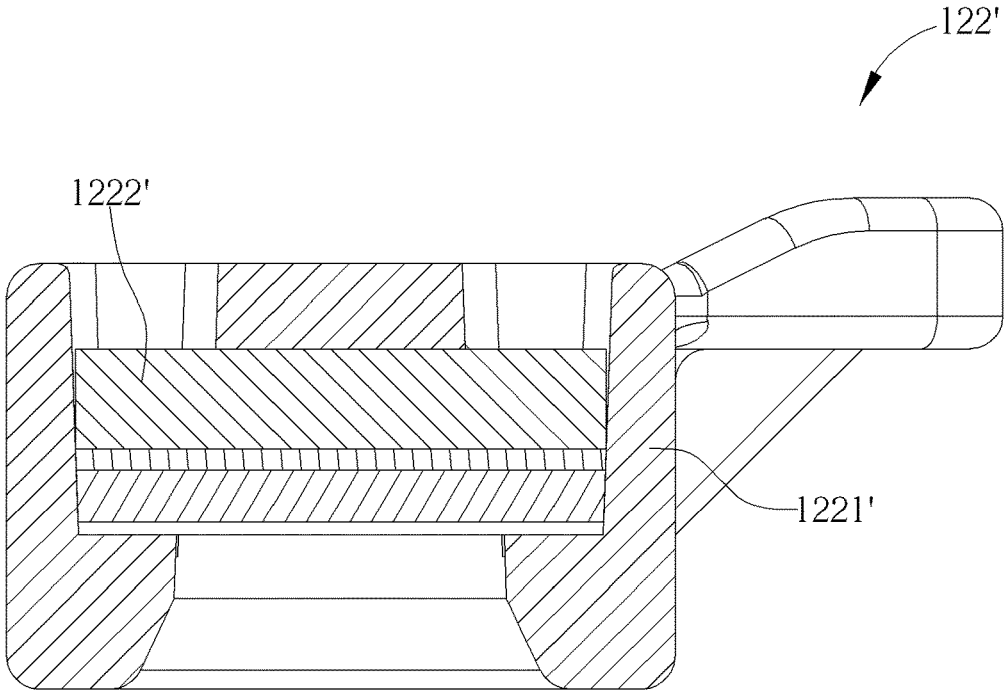
FIG. 5 is a sectional diagram of a covering assembly according to a second embodiment of the present invention.

Please refer to FIG. 5. FIG. 5 is a sectional diagram of a covering assembly 122' according to a second embodiment of the present invention. As shown in FIG. 5, different from the first embodiment, the covering assembly 122' of this embodiment includes a covering component 1221' and a sealing component 1222' which can be a multiple-layer structure made of different elastomeric materials with different hardness.

Figure 6:
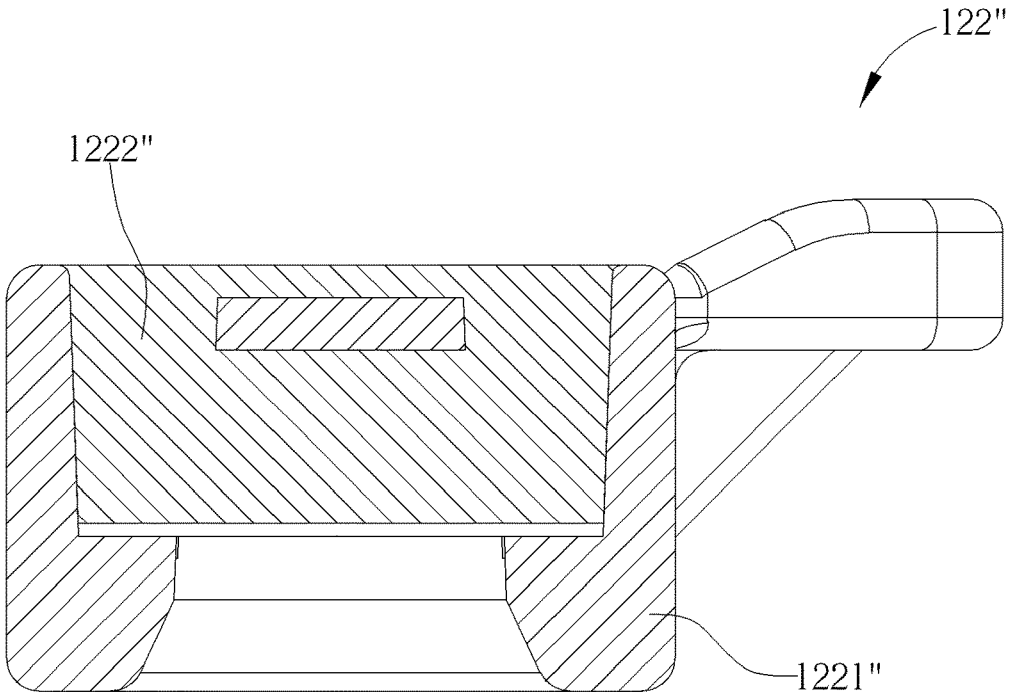
FIG. 6 is a sectional diagram of a covering assembly according to a third embodiment of the present invention.

Please refer to FIG. 6. FIG. 6 is a sectional diagram of a covering assembly 122" according to a third embodiment of the present invention. As shown in FIG. 6, different from the first embodiment, the covering assembly 122" of this embodiment includes a covering component 1221" and a sealing component 1222" which can be a single-layer structure made of elastomeric material and co-molded with the covering component 1221".

Figure 7:
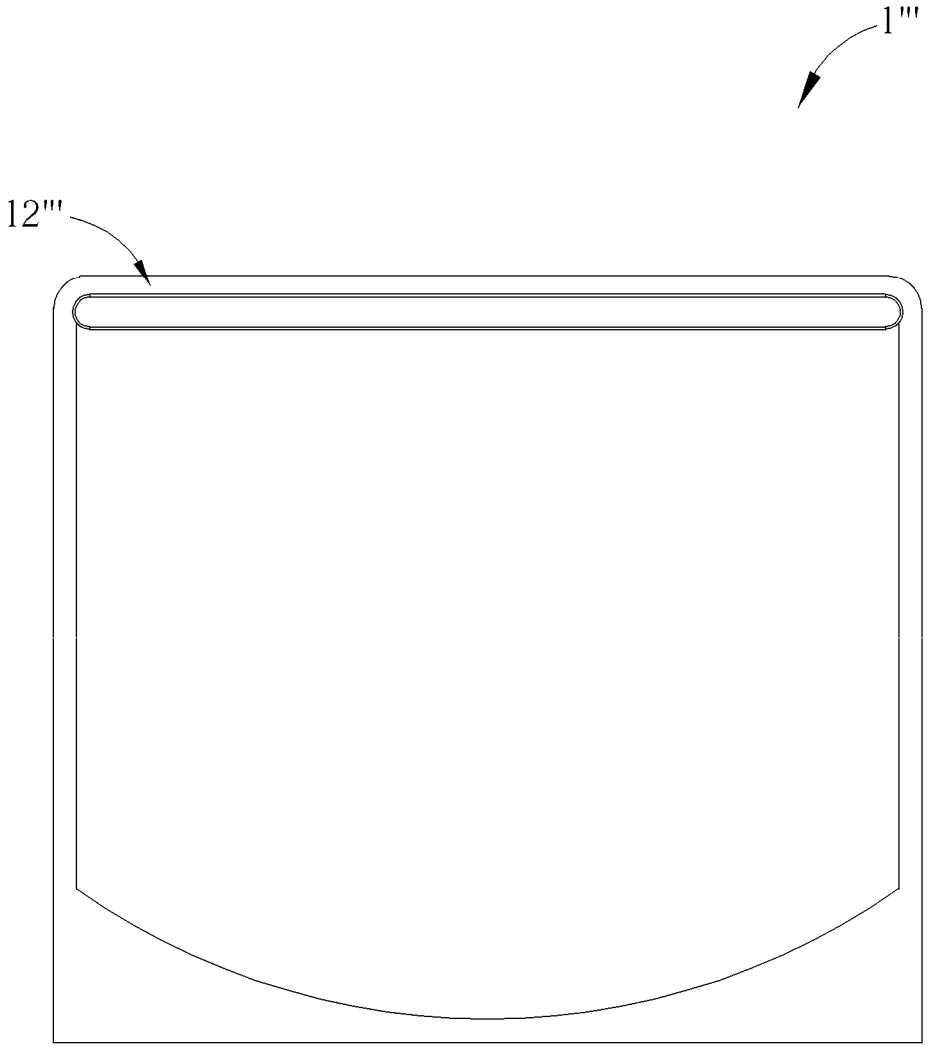
FIG. 7 is a diagram of a sealing bag according to a fourth embodiment of the present invention.
Figure 8:
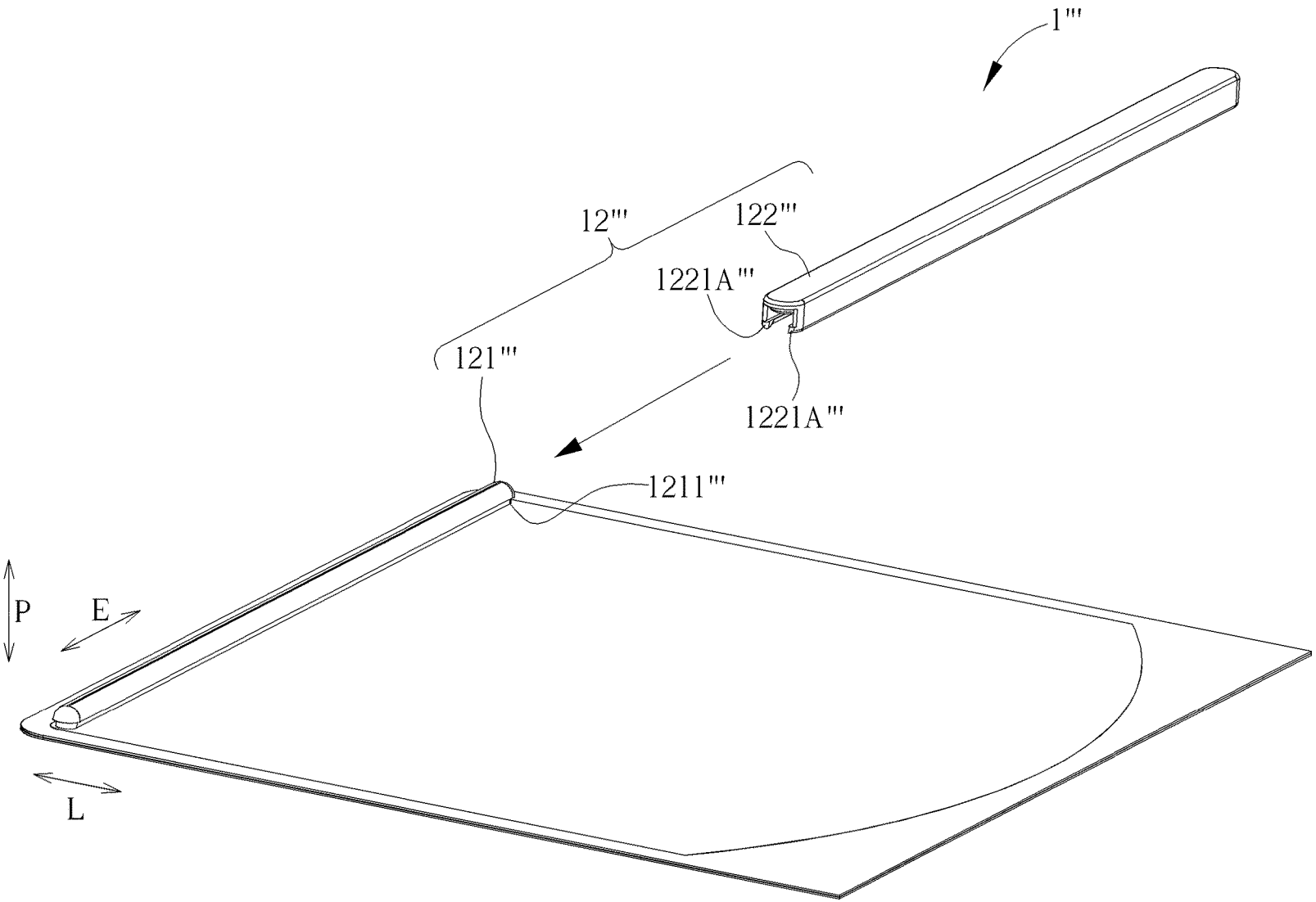
FIG. 8 is a diagram of the sealing bag as a covering assembly is detached according to the fourth embodiment of the present invention.
Figure 9:
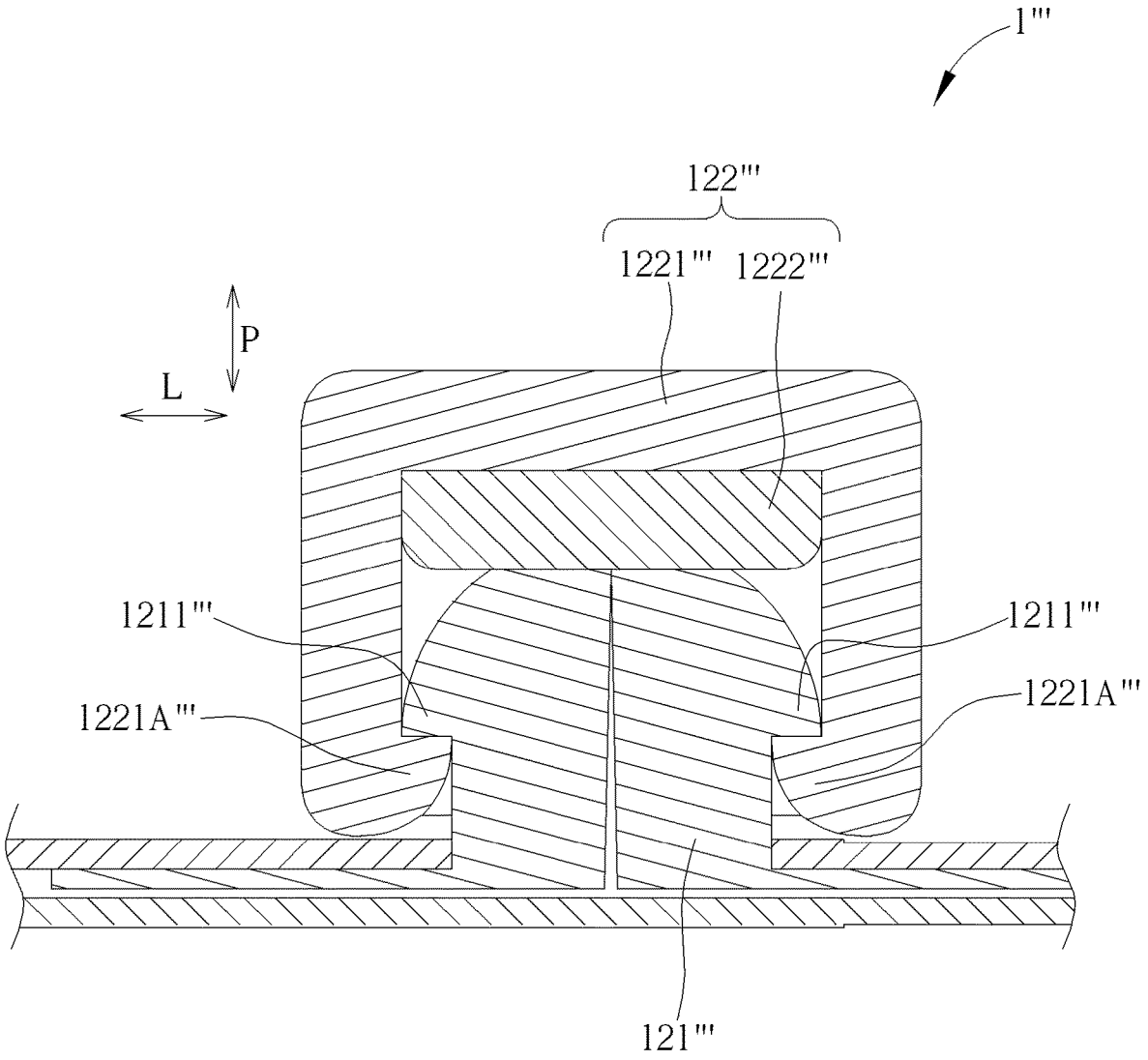
FIG. 9 is a partial enlarged sectional diagram of the sealing bag according to the fourth embodiment of the present invention.

Please refer to FIG. 7 to FIG. 9. FIG. 7 is a diagram of a sealing bag 1''' according to a fourth embodiment of the present invention. FIG. 8 is a diagram of the sealing bag 1''' as a covering assembly 122''' is detached according to the fourth embodiment of the present invention. FIG. 9 is a partial enlarged sectional diagram of the sealing bag 1''' according to the fourth embodiment of the present invention. As shown in FIG. 7 to FIG. 9, different from the first embodiment, a sealing system 12''' of the sealing bag 1''' of this embodiment includes an elastomeric protruding component 121''' and the covering assembly 122''' for detachably engaging with the elastomeric protruding component 121''' in a sliding manner. Specifically, the covering assembly 122''' includes a covering component 1221''' and a sealing component 1222''' detachably installed on the covering component 1221'''. The elastomeric protruding component 121''' includes two first interlocking portions 1211''' which can extend along the extending direction E and be formed in sliding groove structures. The covering component 1221''' includes two second interlocking portions 1221A''' which can extend along the extending direction E and be formed in sliding protrusion structures. The second interlocking portion 1221A''' is slidable relative to the corresponding first interlocking portion 1211''', so that the covering assembly 122''' can be engaged with or disengaged from the elastomeric protruding component 121''' by sliding movement of the second interlocking portion 1221A''' relative to the corresponding first interlocking portion 1211'''.

Figure 10:
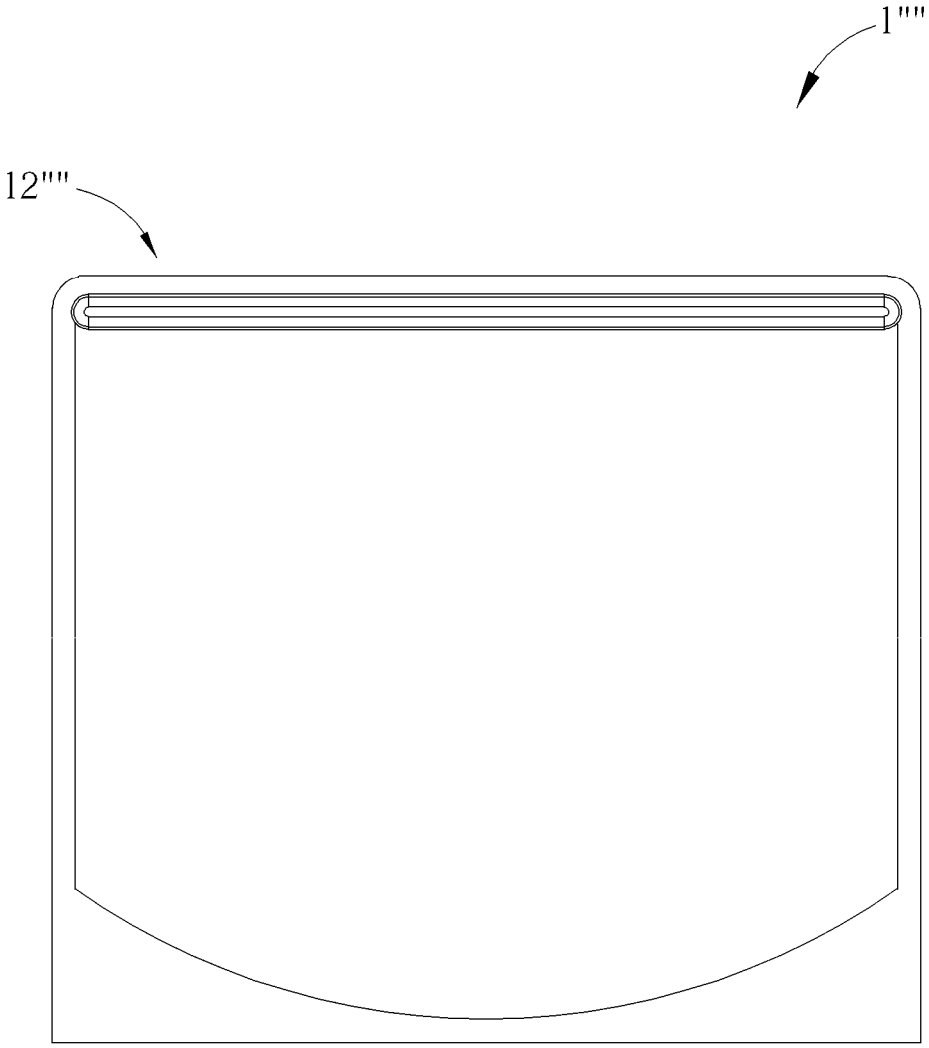
FIG. 10 is a diagram of a sealing bag according to a fifth embodiment of the present invention.
Figure 11:
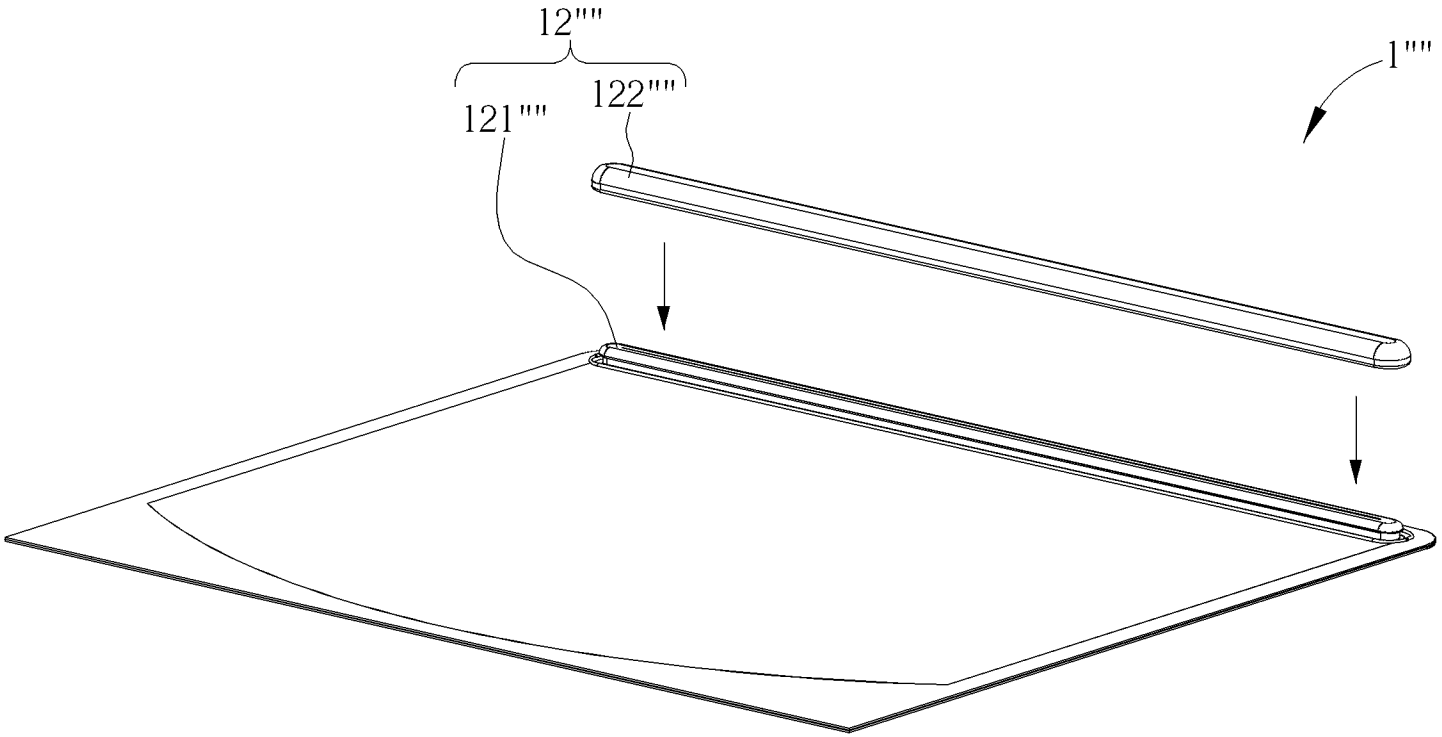
FIG. 11 is a diagram of the sealing bag as a covering assembly is detached according to the fifth embodiment of the present invention.
Figure 12:
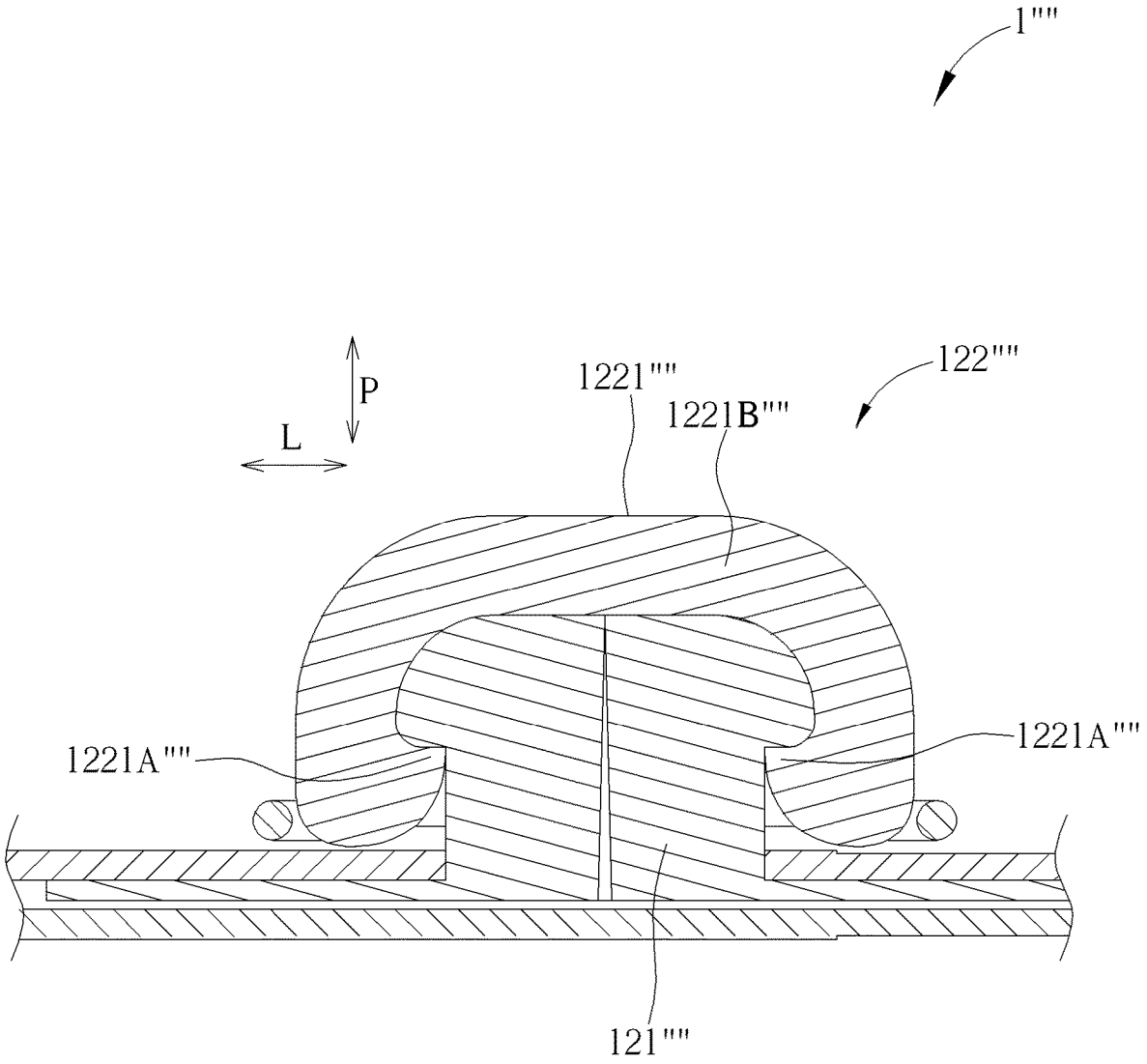
FIG. 12 is a partial enlarged sectional diagram of the sealing bag according to the fifth embodiment of the present invention.

Please refer to FIG. 10 to FIG. 12. FIG. 10 is a diagram of a sealing bag 1'''' according to a fifth embodiment of the present invention. FIG. 11 is a diagram of the sealing bag 1'''' as a covering assembly 122'''' is detached according to the fifth embodiment of the present invention. FIG. 12 is a partial enlarged sectional diagram of the sealing bag 1'''' according to the fifth embodiment of the present invention. As shown in FIG. 10 to FIG. 12, different from the aforementioned embodiments, the covering assembly 122'''' of this embodiment includes the covering component 1221'''' only, and the sealing component is omitted. The covering component 1221'''' engages with the elastomeric protruding component 121'''' in a snapping manner. When the covering component 1221'''' engages with the elastomeric protruding component 121'''', two lateral portions 1221A'''' of the covering component 1221'''' squeeze the elastomeric protruding component 121'''' along the lateral direction L, and a middle portion 1221B'''' connected to the lateral portions 1221A'''' of the covering component 1221'''' squeezes the elastomeric protruding component 121'''' along the protruding direction P, so as to seal a slit of the elastomeric protruding component 121''''.

Figure 13:
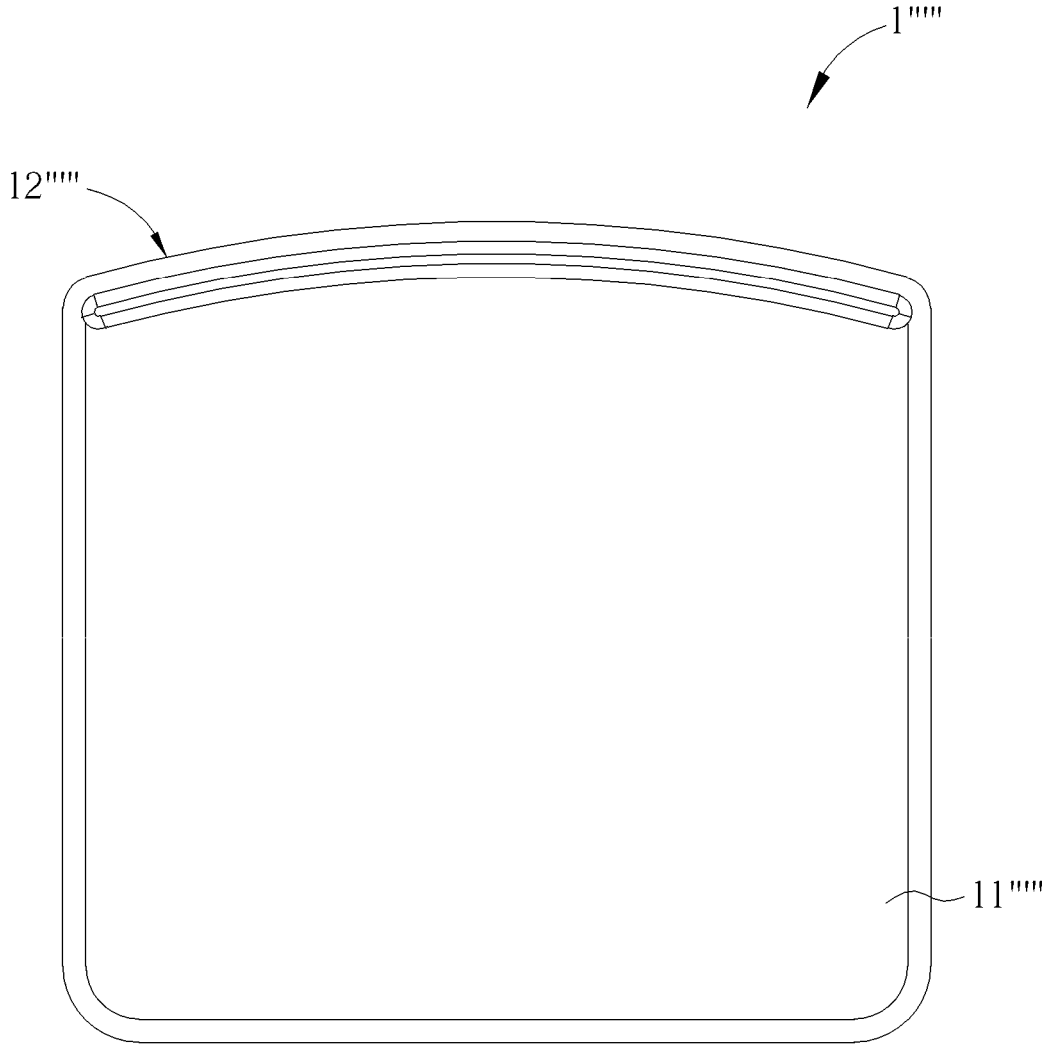
FIG. 13 is a diagram of a sealing bag according to a sixth embodiment of the present invention.
Figure 14:
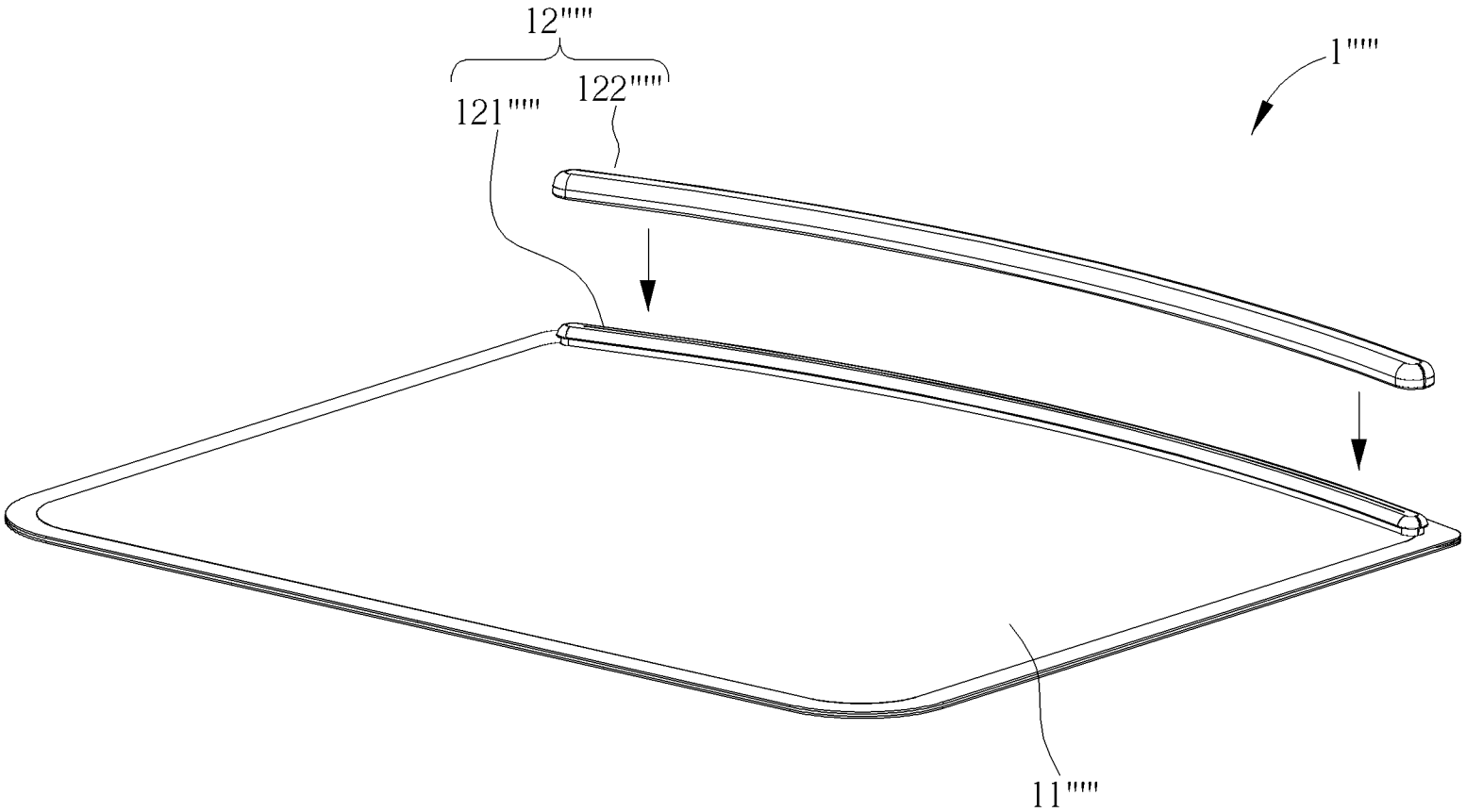
FIG. 14 is a diagram of the sealing bag as a covering assembly is detached according to the sixth embodiment of the present invention.
Figure 15:
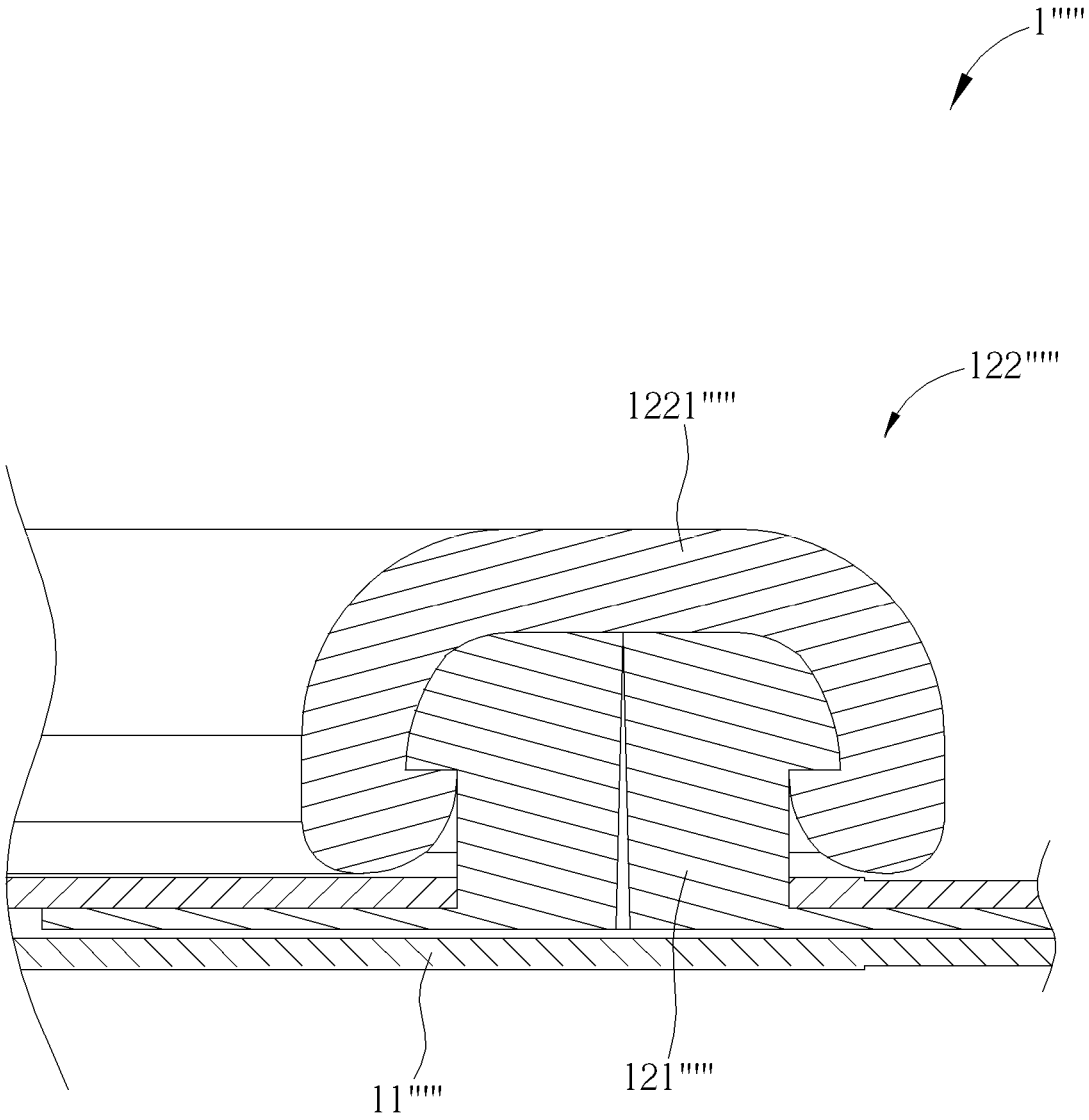
FIG. 15 is a partial enlarged sectional diagram of the sealing bag according to the sixth embodiment of the present invention.

Please refer to FIG. 13 to FIG. 15. FIG. 13 is a diagram of a sealing bag 1''''' according to a sixth embodiment of the present invention. FIG. 14 is a diagram of the sealing bag 1''''' as a covering assembly 122''''' is detached according to the sixth embodiment of the present invention. FIG. 15 is a partial enlarged sectional diagram of the sealing bag 1''''' according to the sixth embodiment of the present invention. As shown in FIG. 13 to FIG. 15, different from the fifth embodiment, each of an elastomeric protruding component 121''''' and a covering component 1221''''' can be formed in a curve-shaped structure, which can provide easier access to an inner space of a bag body 11'''''.

Figure 16:
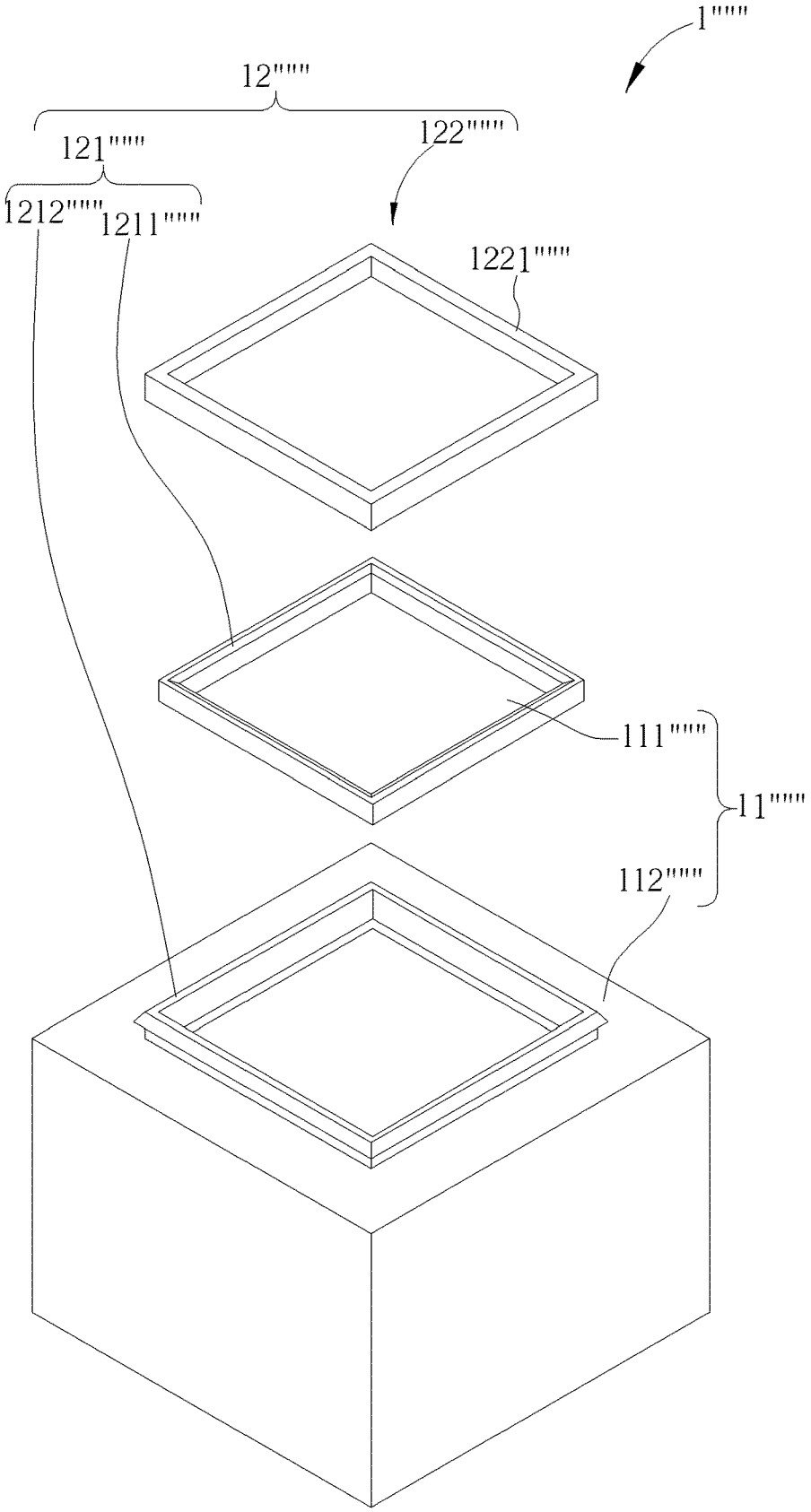
FIG. 16 is a diagram of a sealing container assembly according to a seventh embodiment of the present invention.
Figure 17:
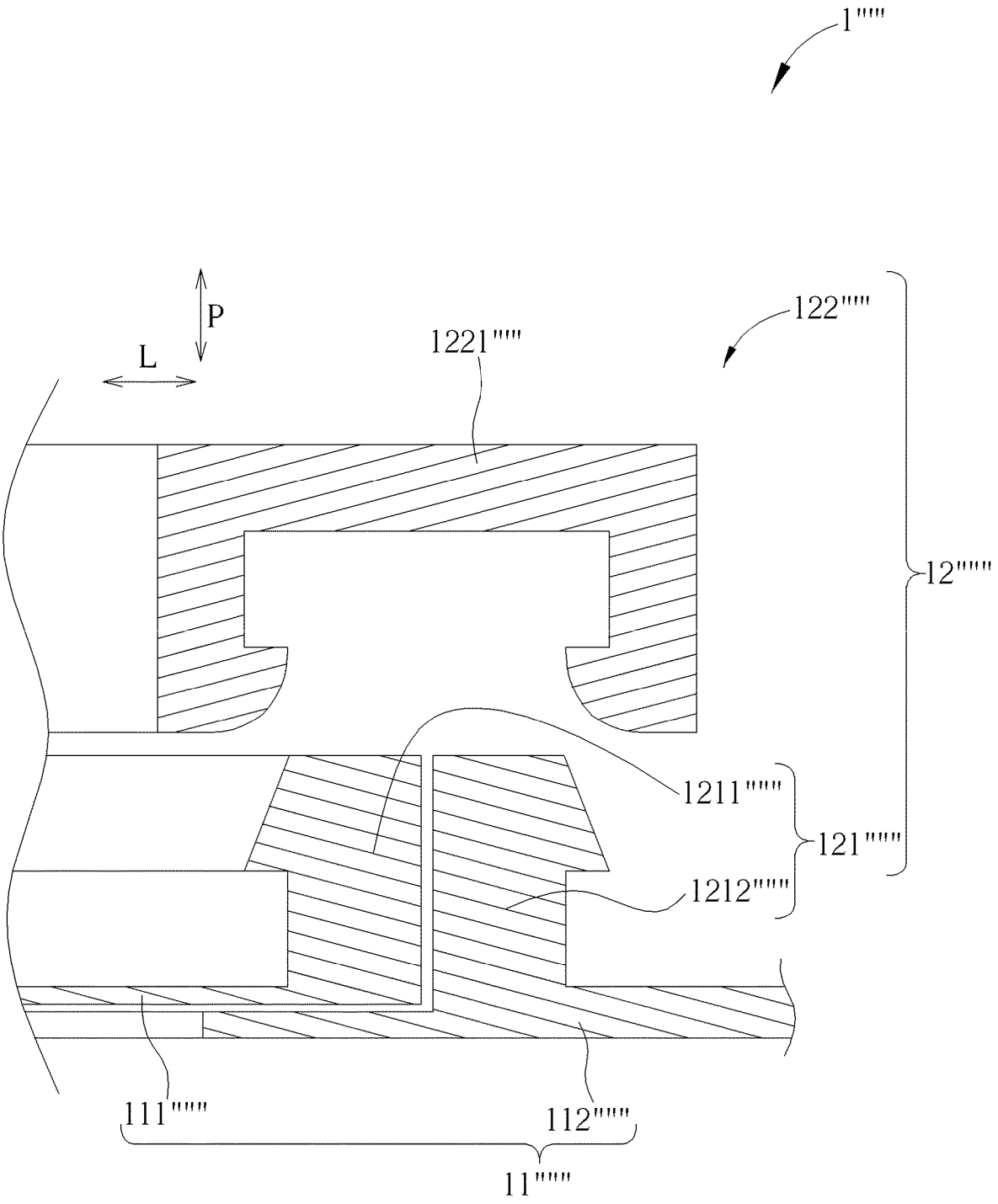
FIG. 17 is a partial enlarged sectional diagram of the sealing container assembly according to the seventh embodiment of the present invention.

Besides, the sealing system of the present invention can be adapted to a container. For example, please refer to FIG. 16 to FIG. 17. FIG. 16 is a diagram of a sealing container assembly 1'''''' according to a seventh embodiment of the present invention. FIG. 17 is a partial enlarged sectional diagram of the sealing container assembly 1'''''' according to the seventh embodiment of the present invention. As shown in FIG. 16 to FIG. 17, the sealing container assembly 1'''''' of this embodiment includes a sealing system 12'''''' and a container 11''''''. The container 11'''''' includes a box cover 111'''''' and a container box 112''''''. The box cover 111'''''' is detachably installed on the container box 112''''''. A first portion 1211'''''' and a second portion 1212'''''' of an elastomeric protruding component 121'''''' of the sealing system 1'''''' can be disposed on the box cover 111'''''' and the container box 112''''''. A covering component 122'''''' of a covering assembly 122'''''' of the sealing system 1'''''' squeezes the elastomeric protruding component 121'''''' along two different directions to seal a slit when the covering component 1221'''''' engages with the elastomeric protruding component 121''''''.

Figure 18:
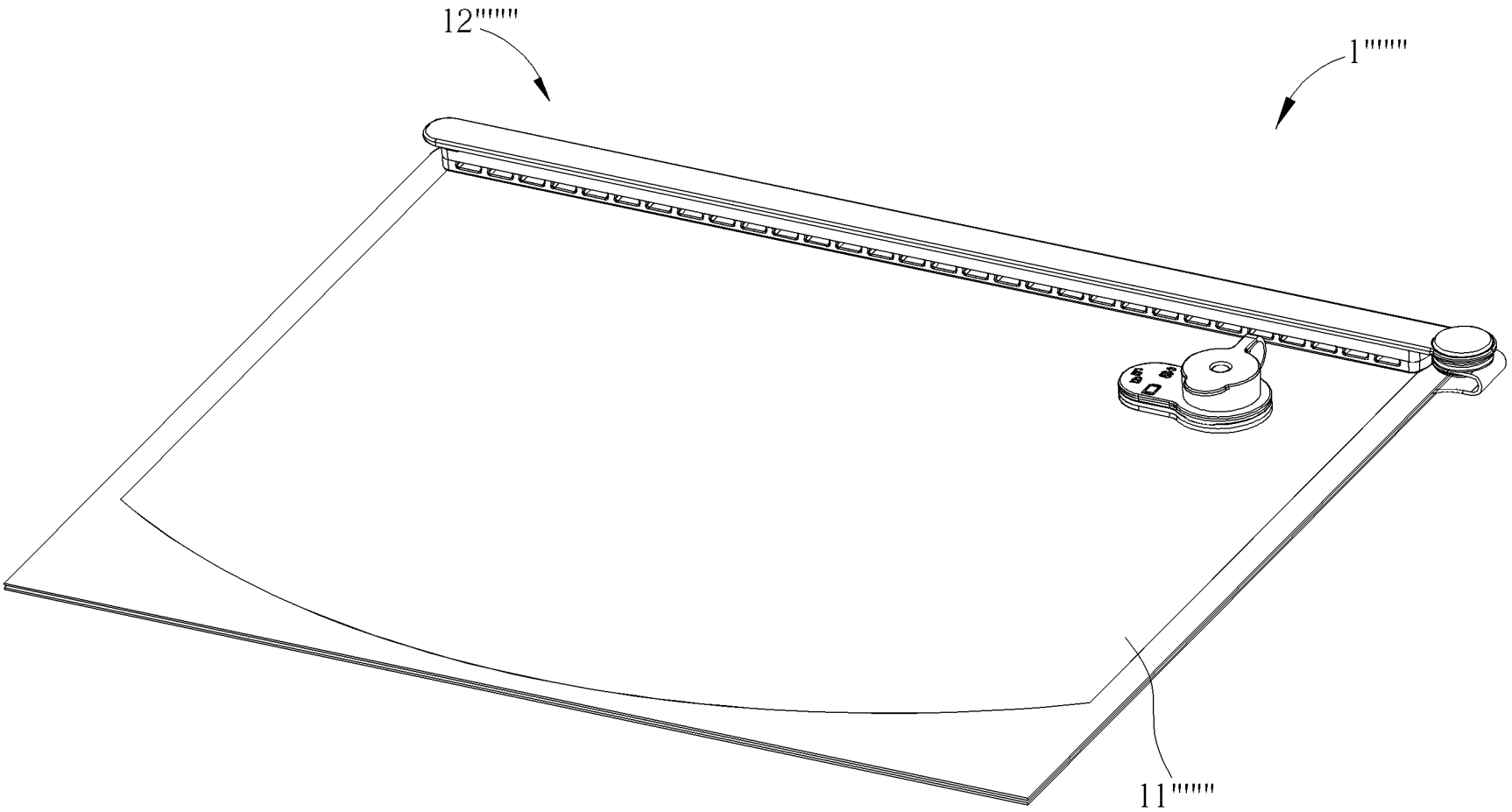
FIG. 18 is a diagram of a sealing bag according to an eighth embodiment of the present invention.
Figure 19:
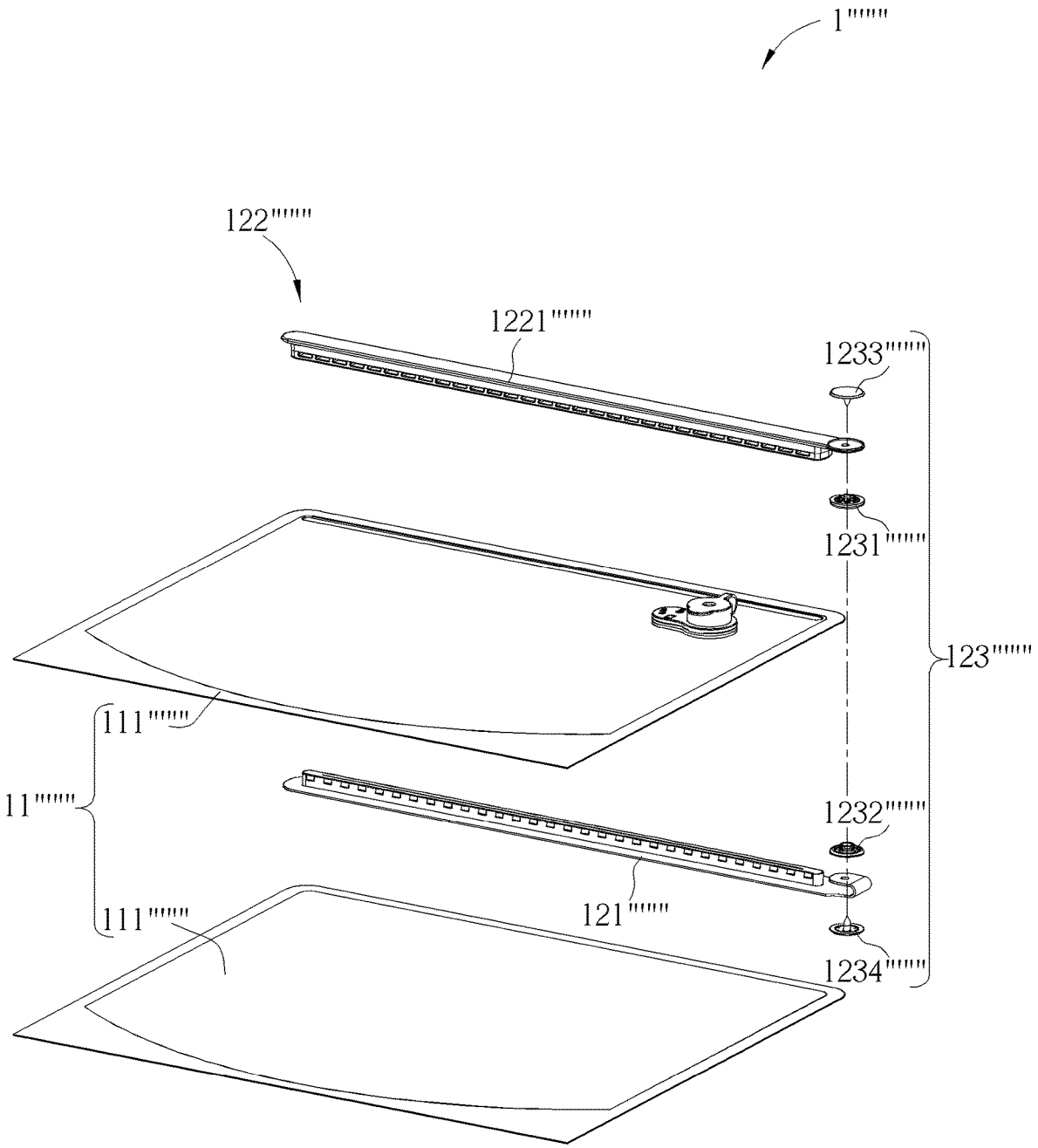
FIG. 19 is an exploded diagram of the seal bag according to the eighth embodiment of the present invention.
Figure 20:
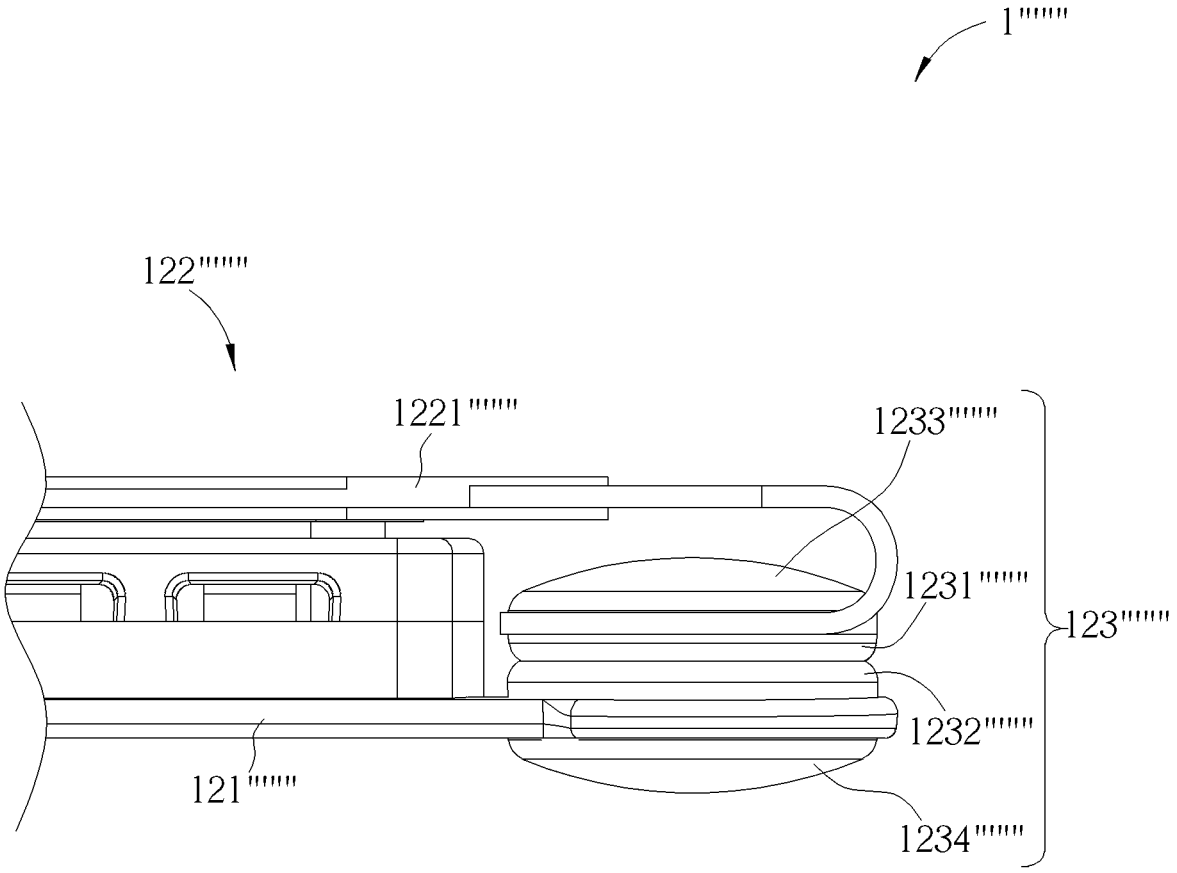
FIG. 20 is a partial enlarged lateral view diagram of the seal bag according to the eighth embodiment of the present invention.

Please refer to FIG. 18 to FIG. 20. FIG. 18 is a diagram of a sealing bag 1''''''' according to an eighth embodiment of the present invention. FIG. 19 is an exploded diagram of the seal bag 1''''''' according to the eighth embodiment of the present invention. FIG. 20 is a partial enlarged lateral view diagram of the seal bag 1''''''' according to the eighth embodiment of the present invention. As shown in FIG. 18 to FIG. 20, the sealing bag 1''''''' of this embodiment includes a bag body 11''''''' and a sealing system 12'''''''. The bag body 11''''''' includes two film layers 111''''''' combined with each other and made of plastic material. The sealing system 12''''''' includes an elastomeric protruding component 121''''''' disposed on the bag body 11''''''' and a covering assembly 122'''''''. The covering assembly 12''''''' includes a covering component 1221''''''' and a sealing component, which is not shown in the figures. The sealing component can be co-molded with the covering component 1221'''''''. Furthermore, the sealing system 12''''''' further includes a buckling assembly 123'''''''. The buckling assembly 123''''''' includes a first buckling component 1231''''''' disposed on the covering component 1221''''''' and a second buckling component 1232''''''' disposed on the elastomeric protruding component 121'''''''. The first buckling component 1231''''''' is detachably buckled with the second buckling component 1232''''''', so that the covering component 1221''''''' is attached to the elastomeric protruding component 121''''''' when the covering component 1221''''''' disengages from the elastomeric protruding component 121''''''', which prevents loss of the covering component 1221'''''''. In this embodiment, preferably, the first buckling component 1231''''''' can be a female buckle detachably installed on the covering component 1221''''''' by a first fixing component 1233''''''', and the second buckling component 1232''''''' can be a male buckle detachably installed on the elastomeric protruding component 121''''''' by a second fixing component 1234'''''''. However, the present invention is not limited to this embodiment. For example, in another embodiment, the first buckling component can be a male buckle fixed with the covering component, and the second buckling component can be a female buckle fixed with the elastomeric protruding component. Alternatively, in another embodiment, the elastomeric protruding component can be fixedly combined with the covering component by a plastic connecting component.

In contrast to the prior art, the present invention utilizes the covering assembly for detachably engaging with the elastomeric protruding component disposed on the bag body or the container. The covering assembly squeezes the elastomeric protruding component along two different directions to seal the slit on the elastomeric protruding component when the covering assembly engages with the elastomeric protruding component. Such mechanism can ensure nothing goes into the bag body or comes out of the bag body when the slit is sealed. Therefore, the present invention has enhanced reliability of sealing the sealing bag.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sealing bag comprising:

a bag body; and a sealing system comprising:

an elastomeric protruding component disposed on the bag body and protruding from the bag body along a protruding direction, the protruding direction being parallel to a normal direction of a wall of the bag body where the elastomeric protruding component is disposed, a slit penetrating through the elastomeric protruding component along the protruding direction and being communicated with an inner space of the bag body;

a covering assembly for detachably engaging with the elastomeric protruding component, the covering component snapping the elastomeric protruding component along the protruding direction to engage with the elastomeric protruding component, the covering assembly squeezing the elastomeric protruding component along the protruding direction and a lateral direction different from the protruding direction to seal the slit when the covering assembly engages with the elastomeric protruding component, the covering assembly comprising:

a covering component for engaging with the elastomeric protruding component and squeezing the elastomeric protruding component along the lateral direction; and a sealing component disposed on the covering component, the sealing component squeezing the elastomeric protruding component along the protruding direction when the covering component engages with the elastomeric protruding component.

2. The sealing bag of claim 1, wherein the elastomeric protruding component comprises at least one first interlocking portion, and the covering component comprises at least one second interlocking portion for detachably engaging with the at least one first interlocking portion.

3. The sealing bag of claim 1, wherein the sealing component is detachably installed on or co-molded with the covering component.

4. The sealing bag of claim 1, wherein the sealing component is a single-layer structure or a multi-layer structure.

5. The sealing bag of claim 4, wherein the multi-layer structure comprises a plurality of layer components made of materials with different hardness.

6. The sealing bag of claim 1, wherein the sealing component is made of elastomeric material.

7. The sealing bag of claim 1, wherein the lateral direction is perpendicular to the protruding direction, and the elastomeric protruding component extends along an extending direction perpendicular to the protruding direction and the lateral direction.

8. The sealing bag of claim 1, wherein the sealing system further comprises a vacuum valve disposed on the bag body for allowing or restraining discharge of fluid inside the inner space of the bag body.

9. The sealing bag of claim 1, wherein the covering component is attached to or separated from the bag body.

10. The sealing bag of claim 1, wherein the covering component is attached to or separated from the elastomeric protruding component.

11. The sealing bag of claim 10, wherein the sealing system further comprises a buckling assembly, the buckling assembly comprises a first buckling component detachably disposed on the covering component and a second buckling component detachably disposed on the elastomeric protruding component for being detachably buckled with the first buckling component.

12. A sealing system for a container, the sealing system comprising:

an elastomeric protruding component disposed on the container, the elastomeric protruding component protruding from the container along a protruding direction, the protruding direction being parallel to a normal direction of a wall of the container where the elastomeric protruding component is disposed, a slit penetrating through the elastomeric protruding component along the protruding direction and being communicated with an inner space of the container; and a covering assembly comprising a covering component for detachably engaging with the elastomeric protruding component, the covering component snapping the elastomeric protruding component along the protruding direction to engage with the elastomeric protruding component, the covering assembly squeezing the elastomeric protruding component along two different directions to seal the slit when the covering component engages with the elastomeric protruding component.

13. The sealing system of claim 12, wherein the elastomeric protruding component comprises at least one first interlocking portion, and the covering component comprises at least one second interlocking portion for detachably engaging with the at least one first interlocking portion.

14. The sealing system of claim 12, wherein the covering assembly further comprises a sealing component disposed on the covering component, and the sealing component seals the slit when the covering component engages with the elastomeric protruding component.

15. The sealing system of claim 14, wherein the sealing component is detachably installed on or co-molded with the covering component.

16. The sealing system of claim 14, wherein the covering assembly squeezes the elastomeric protruding component along the protruding direction and a lateral direction perpendicular to the protruding direction to seal the slit when the covering component engages with the elastomeric protruding component.

17. The sealing system of claim 16, wherein the elastomeric protruding component extends along an extending direction perpendicular to the protruding direction and the lateral direction.

18. The sealing system of claim 14, wherein the sealing component is a single-layer structure or a multi-layer structure.

19. The sealing system of claim 18, wherein the multi-layer structure comprises a plurality of layer components made of materials with different hardness.

20. The sealing system of claim 14, wherein the sealing component is made of elastomeric material.

21. The sealing system of claim 12, wherein the elastomeric protruding component extends along an extending direction perpendicular to the protruding direction, and the covering assembly squeezes the elastomeric protruding component along the protruding direction and a lateral direction perpendicular to the protruding direction and the extending direction to seal the slit when the covering component engages with the elastomeric protruding component.

22. The sealing system of claim 12, further comprising a vacuum valve disposed on the container for allowing or restraining discharge of fluid inside the inner space of the container.

23. The sealing system of claim 12, wherein the covering component is attached to or separated from the container.

24. The sealing system of claim 12, wherein the covering component is attached to or separated from the elastomeric protruding component.

25. The sealing system of claim 12, further comprising a buckling assembly, the buckling assembly comprising a first buckling component detachably disposed on the covering component and a second buckling component detachably disposed on the elastomeric protruding component for being detachably buckled with the first buckling component.

* * * * *